US007007433B2

(12) United States Patent
Boyer

(10) Patent No.: US 7,007,433 B2
(45) Date of Patent: Mar. 7, 2006

(54) FEATURES FOR THIN COMPOSITE ARCHITECTURAL PANELS

(75) Inventor: Keith Boyer, Moon Township, PA (US)

(73) Assignee: CENTRIA, Moon Township, PA (US)

( * ) Notice: Subject to any disclaimer, the term of this patent is extended or adjusted under 35 U.S.C. 154(b) by 0 days.

(21) Appl. No.: 10/342,155

(22) Filed: Jan. 14, 2003

(65) Prior Publication Data

US 2004/0134143 A1 Jul. 15, 2004

(51) Int. Cl.
*E04C 1/01* (2006.01)
*E04B 2/30* (2006.01)
*E04B 2/08* (2006.01)

(52) U.S. Cl. ..... 52/309.9; 52/592.1; 52/483.1

(58) Field of Classification Search ..... 52/650.3, 52/478, 483.1, 309.9, 309.14, 589.1, 592.1, 52/794.1, 588.1, 800.12, 800.1; 29/897.32, 29/827.1; 403/270
See application file for complete search history.

(56) References Cited

U.S. PATENT DOCUMENTS

| | | | | | |
|---|---|---|---|---|---|
| 3,667,180 | A * | 6/1972 | Tischuk | 52/309.2 | |
| 3,828,493 | A * | 8/1974 | Vezmar | 52/1 | |
| 4,037,377 | A * | 7/1977 | Howell et al. | 52/309.9 | |
| 4,100,710 | A | 7/1978 | Kowallik | | |
| 4,104,840 | A | 8/1978 | Heintz et al. | | |
| 4,123,885 | A * | 11/1978 | Scott | 52/489.1 | |
| 4,177,615 | A * | 12/1979 | Anderson | 52/478 | |
| 4,184,301 | A * | 1/1980 | Anderson et al. | 52/478 | |
| 4,304,083 | A * | 12/1981 | Anderson | 52/509 | |
| 4,316,351 | A | 2/1982 | Ting | | |
| 4,700,520 | A | 10/1987 | Ting | | |
| 4,743,485 | A | 5/1988 | Ting | | |
| 5,030,488 | A | 7/1991 | Sobolev | | |
| 5,219,629 | A | 6/1993 | Sobolev | | |
| 5,277,011 | A | 1/1994 | Serrano Martin | | |
| 5,285,609 | A | 2/1994 | Goad | | |
| 5,425,210 | A | 6/1995 | Zafir | | |
| 5,577,363 | A | 11/1996 | Tate et al. | | |
| 5,673,524 | A | 10/1997 | Gailey | | |
| 5,749,282 | A | 5/1998 | Brow et al. | | |
| 6,096,416 | A | 8/2000 | Altenberg | | |
| 6,099,680 | A * | 8/2000 | Harris et al. | 156/279 | |
| 6,253,511 | B1 | 7/2001 | Boyer | | |
| 6,298,626 | B1 | 10/2001 | Rudden | | |
| 6,564,521 | B1 * | 5/2003 | Brown et al. | 52/309.1 | |

FOREIGN PATENT DOCUMENTS

| | | |
|---|---|---|
| EP | 0345416 | 12/1989 |
| EP | 0636752 | 1/1995 |
| FR | 2731029 | 8/1996 |

* cited by examiner

*Primary Examiner*—Peter M. Cuomo
*Assistant Examiner*—Sarah C. Burnham
(74) *Attorney, Agent, or Firm*—Reed Smith LLP

(57) ABSTRACT

Thin composite panels with interconnection schemes that are unitized with the panels, i.e., formed integrally and substantially simultaneously with the panels. Further contemplated is the application of an injection molding technique, such as reaction injection molding, in establishing a foam or polymeric core between laminates in thin composite panels. Additionally contemplated is the use of interchangeable laminate components in affording the capability of altering the coloring or other visual features of a reveal in a panel or panels.

20 Claims, 3 Drawing Sheets

FEATURES FOR THIN COMPOSITE ARCHITECTURAL PANELS

FIELD OF THE INVENTION

The present invention generally relates to thin composite architectural panels, and methods of making and assembling the same.

BACKGROUND OF THE INVENTION

To date, thin composite architectural wall panels have been manufactured in multi-step processes which often involve both sheet manufacturers and panel fabricators. First, a thin composite sheet is manufactured by laminating metal skins to a plastic core. (An example of such a composite sheet is the "ALUCOBOND" material produced by Alusuisse Group, Ltd., Zurich, Switzerland.) Next, these sheets are typically shipped to a fabricator where they are cut to size and routed so as to return the edges around the perimeter. Typically, extrusions are fabricated and applied to the panel perimeter to create panel joinery. Also, stiffeners are typically applied in the field (i.e., the major flattened portion) of the panel to reduce the bowing of the thin panel under load. All of this tends to represent rather cumbersome and costly processes. ("Thin composite panel" and "thin composite architectural panel" are widely recognized as essentially interchangeable terms of art that relate to a specific genre of architectural panels, configured substantially as described above, whereby a thickness dimension as measured between opposing faces in the field of the panel can generally be between about 4 mm and about 6 mm, though a greater range of thicknesses, such as less than about 15 mm or less than about 10 mm are feasible.)

Another currently available architectural panel product is embodied by a thicker composite foam panel which is made from metal skins sandwiching an insulated foam core. Such panels are widely known; examples thereof are disclosed, for instance, in U.S. Pat. No. 5,749,282 to Brow et al. Attendant manufacturing processes tend to be quicker and can involve lower manufacturing costs than with the conventional thin composite processes described above, but here manufacturing limitations do exist. An evolving need has thus been recognized in connection with imparting to the manufacture of thin composite panels a measure of ease and convenience typically enjoyed in connection with the manufacture of thicker composite panels.

In view of the foregoing, there are specific aspects of conventional thin composite panels and their manufacture which appear to be ripe for improvement. One such aspect involves the schemes of interconnection between thin composite panels (i.e., the available connection arrangement at an interface between one thin composite panel and another). Historically, extruded interconnections of complex design have been utilized in such contexts, and such extruded interconnections have most often lent themselves to a manufacturing process completely separate from the manufacture of the panels themselves. Thus, a tremendous need has been recognized in connection with eradicating the associated inefficiencies in manufacture and possibly wasteful investment in separate materials.

In the realm of providing a foam or polymeric (e.g., polyurethane) core to be sandwiched between laminates, conventional approaches have tended to emphasize poured-in-place processes that can often provide significant investments of time and resources to the process of manufacturing thin composite panels. A need has thus also been recognized in connection with providing a more efficient manner of establishing a foam or polymeric core in thin composite panels.

Finally, history has seen various efforts made towards imparting distinct coloring or other supplementary visual features to a panel reveal. (A "reveal", as generally known in the art, may be defined as a recessed region in the face of an architectural panel, and which may be disposed solely in one panel or defined between two panels, that itself normally lends a significant visual enhancement to a panel or building wall even without coloring or other supplementary visual features.) To date, it has generally been the case that only rudimentary methods have been contemplated for the purpose, such as, for example, the application of colored tape strips to a rear portion of the reveal. Accordingly, a need has been recognized in connection with providing a more effective and permanent method for imparting coloring or other supplementary visual features to a reveal.

SUMMARY OF THE INVENTION

Generally, there are broadly contemplated, in accordance with at least one presently preferred embodiment of the present invention, various features for incorporation in the environment of thin composite panels that admirably address the problems discussed above.

In accordance with an embodiment of the present invention, there are preferably provided schemes of interconnection between thin composite panels that are unitized with the panels, i.e., formed integrally and substantially simultaneously with the panels in question.

In the context of the manufacture of thin composite panels, there is preferably provided in accordance with another embodiment of the present invention the application of an injection molding technique, such as reaction injection molding, in establishing a foam or polymeric core between laminates.

There is also broadly contemplated, in accordance with another embodiment of the present invention, the use of interchangeable laminate components in affording the capability of altering the coloring or other visual features of a reveal in a panel or panels.

Generally, there is broadly contemplated in accordance with at least one presently preferred embodiment of the present invention a thin composite architectural panel comprising: a structural core; a set of laminates disposed about the structural core; a first portion for interfacing and facilitating interconnection with another thin composite architectural panel; a second portion for interfacing and facilitating interconnection with another thin composite architectural panel; the first interfacing portion comprising a first lip portion adapted to be interposed between a wall and a lip portion of another thin composite architectural panel in a building wall assembly; and the second interfacing portion comprising a second lip portion adapted to flank, with a wall, a lip portion of another thin composite architectural panel in a building wall assembly; whereby the introduction of a sealant between the first lip portion and a lip portion of another thin composite architectural panel is facilitated; whereby the introduction of a sealant between the second lip portion and a lip portion of another thin composite architectural panel is facilitated.

Further, there is broadly contemplated in accordance with at least one presently preferred embodiment of the present invention a thin composite architectural panel comprising: a structural core; a set of laminates disposed about the structural core; wherein the structural core has been introduced between the laminates via reaction injection molding.

Additionally, there is broadly contemplated in accordance with at least one presently preferred embodiment of the present invention a method of forming a thin composite architectural panel, the method comprising the steps of: providing a set of laminates; and introducing a structural core between the laminates via reaction injection molding.

Furthermore, there is broadly contemplated in accordance with at least one presently preferred embodiment of the present invention a thin composite panel comprising: a structural core; a set of laminates disposed about the structural core; at least one interchangeable component adapted to impart a pre-selectable appearance solely to a reveal associated with the panel.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

As touched upon heretofore, thin composite architectural panels, also known as thin composite wall panels, are recognized in the art as normally encompassing a laminated composite including a polymeric or foam core sandwiched between two laminates, e.g., metal skins.

Figure 1:
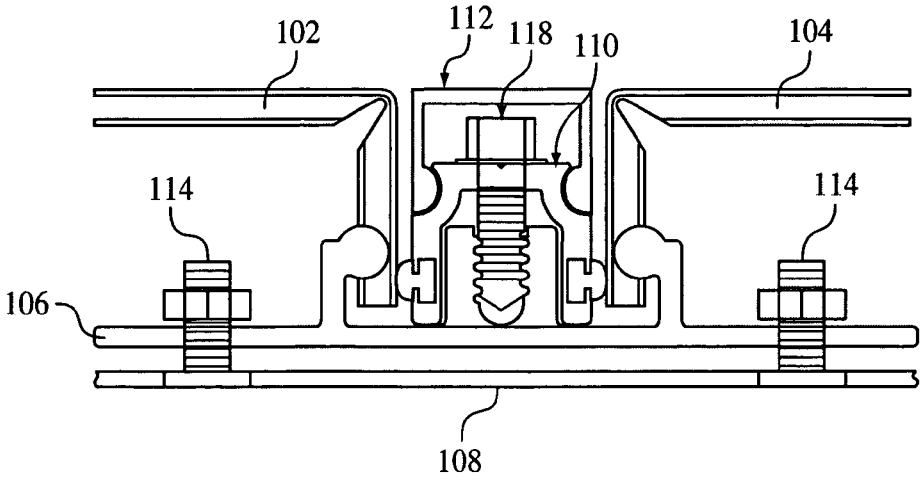
FIG. 1 PRIOR ART
FIG. 1 is a plan cut-away view of conventional thin composite panels and an extruded connection therebetween.

Conventionally, sheets of a thin composite are fabricated by cutting them to size and bending their ends at right angles via routing. The panels are typically adjoined to one another, between bent ends, via extruded joining mechanisms. Shown in FIG. 1 is such a conventional arrangement. As shown, two bent vertical thin composite panels 102 and 104 are joined at a vertical joint via an extruded connector indicated at 106. (The relatively small thickness dimension of the panels 102 and 104 is to be noted, as starkly opposed to "thick" building panels whose thickness may extend, e.g., all the way back to a building structure as indicated at 108.) Other components that may typically be provided include a pressure channel 110, snap cover 112, flange bolts/nuts 114 and a machine screw 118.

Though the extruded connector 106 shown in FIG. 1 is of a particular configuration and size for the application at hand, such connectors of course have assumed other configurations and sizes as needed. Generally, it should be understood that a primary problem presented by such a connectors overall is that these are components formed in a separate process from the composite panels, thus necessitating a complicated procedure of first producing the panels, separately producing the extruded connector (conceivably to customized, and not necessarily universal, specifications), and then finally assembling the three components on-site.

By contrast, there is broadly contemplated, in accordance with at least one presently preferred embodiment of the present invention, the absence of an extruded connection such as that shown in FIG. 1. More particularly, there is broadly contemplated in accordance with a preferred embodiment the use of metal sheet elements in forming a thin composite architectural panel and in providing effective joinery. Examples of metal sheet elements are indicated at 202, 204, 206 and 208, schematically in FIG. 2*a* and in more detail in FIG. 2*b*. The larger elements 202, 204 may preferably be roll-formed given their great extent, while the smaller elements 206, 208 could preferably be formed by a process such as via folding or a press-break. As shown, a face sheet 202 (i.e., that will be oriented externally and thus viewable on the exterior of a building wall) may preferably be integrable with liner elements 204, 206 and 208 (i.e., that will be disposed towards the interior of a building wall and thus will largely not be visible on the exterior of the building wall).

Figure 2A:
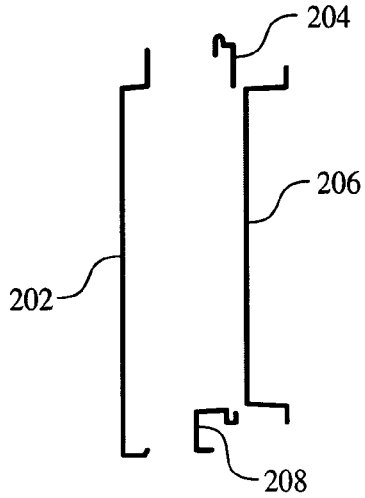
FIG. 2*a* is a schematic view of metal skin components of a thin composite panel.
Figure 2B:
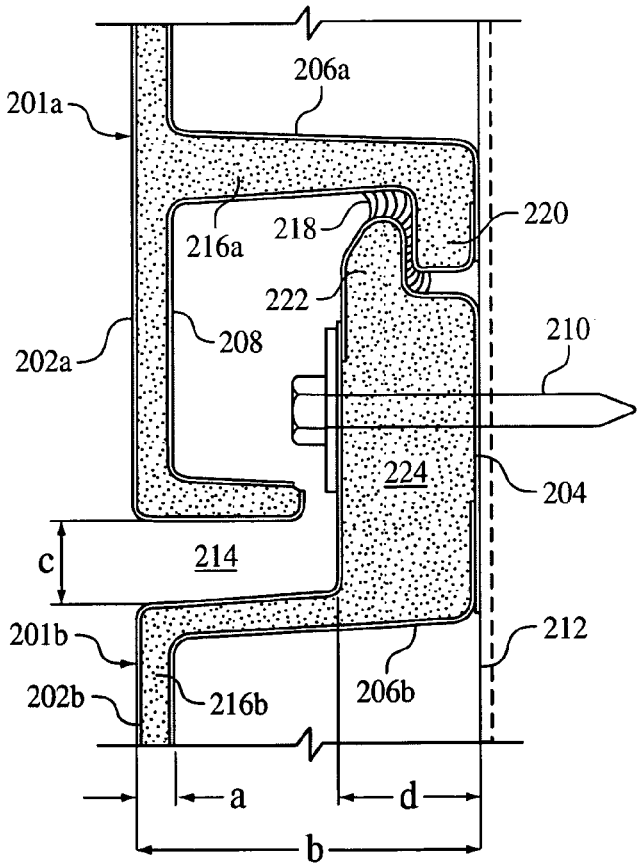
FIG. 2*b* is a close-up view of an interconnection between two thin composite panels using the metal skin components of FIG. 2*a;*

As can be appreciated from FIG. 2*a*, metal sheet elements (which may alternatively be termed "laminates" or "laminate components") 202, 204, 206, 208 can preferably be integrable with one another to create an interior space for the receipt of foam or polymer (e.g., polyurethane) in forming a structural core for a thin composite panel. FIG. 2*b*, on the other hand, affords a close-up view of an interconnection between two adjacent thin composite panels 201*a* and 201*b*. It should be understood that FIG. 2*b* can be representative either of a horizontal joint connection between two adjacent horizontal thin composite panels or a vertical joint connection between two adjacent vertical thin composite panels.

The four metal sheet elements 202/204/206/208, or laminates, depicted in FIG. 2*a* are evident in FIG. 2*b*, though in FIG. 2*b* they are not entirely shown with respect to both panels 201*a* and 201*b*. As shown, face sheet element 202*a* of first panel 201*a* traverses flatly over a significant portion of the front of first panel 201*a* (i.e., has an ample module, or frontal dimension in the vertical direction with respect to FIGS. 2*a* and 2*b*, e.g. of about 57 inches or a little less) and then terminates at a return edge that may form the upper portion of a reveal 214. On the other hand, major liner sheet element 206*a*, that is by and large parallel to face sheet element 202*a*, terminates by progressing inwardly towards the inner wall 212 and then, briefly, in parallel to wall 212 as shown. Liner element 208 essentially interconnects the terminal portions of elements 202*a* and 206*a* via an essentially parallel orientation with respect to portions of elements 202*a* and 206*a* as shown, and itself preferably terminates in a cross-sectional "u" adjacent inner wall 212 where it briefly overlaps the end portion of element 206*a*.

As shown with respect to second panel 201*b*, a face sheet element 202*b* may preferably terminate here by progressing inwardly towards inner wall 212 and thence again in parallel with respect to inner wall 212. Major liner sheet element 206*b* may preferably terminate similarly, although it will preferably extend virtually the entire distance to inner wall 212 before again running parallel with respect thereto. Liner element 204 is preferably configured to interconnect the terminal portions of elements 202*b* and 206*b* as shown, particularly, via briefly overlapping element both elements 202*b* and 206*b*.

It should be understood that, with reference to the embodiment depicted in FIG. 2*b*., panels 201*a* and 201*b* will preferably be configured similarly to one another over their entire extent.

For the purpose of facilitating the interconnection of panels 201*a* and 201*b*, and attachment fastener is preferably provided to attach panel 201*b* to inner wall 212 while sealant 218 will preferably be provided between liner elements 208 and 204 in a gap formed therebetween.

When required, stiffeners (not illustrated), which are typically separate elements interposed between a thin composite and inner wall as known in the art, may be used to control cross-bowing of wide modules under suction loads.

Sample dimensions with respect to the embodiment shown in FIG. 2*b* may include a thickness a of between about 6 and about 8 mm in the major flat, frontal portion of each panel and a distance b of about 2 inches from the frontmost portion of each panel to inner wall 212. Dimension c, or the frontal width of a reveal 214 formed between the panels 201*a*/201*b* can be customizably varied by appropriately configuring skin elements 202*b* and 206*b*.

The features and dimensions depicted and described with respect to FIGS. 2*a* and 2*b* are of course merely illustrative and not restrictive with respect to the large variety of configurations that can be carried out within the scope of the present invention. Essentially, there is broadly contemplated in accordance with at least one presently preferred embodiment of the present invention the eased manufacture and assembly of thin composite panels, via the use of customizable formed sheet elements such as 202/204/206/208, as well as the eased interconnection of such panels via the optimized geometry and orientation of such components at their end portions. Thus, for instance, interconnection between panels in the embodiment shown in FIG. 2*b* is facilitated by the interposition of a "u" portion (or lip portion) 220 of first panel 201*a* (afforded by liner element 208) between a "hump" portion (or lip portion) 222 of second panel 201*b* (afforded by liner element 204) and inner wall 212, and providing sealant 218 in the gap therebetween. It will be appreciated that this affords a strong and rigid connection between panels 201*a* and 201*b*, especially with the assistance of the anchoring effect provided by attachment fastener 210 with respect to panel 201*b*.

It will be appreciated that the use of roll-formed sheet elements in establishing the perimeter appears to lend itself to an easier and less costly scheme of interconnection between panels than in the case of extruded joinery (as in FIG. 1).

Among the unique advantages and features associated with panel products such as those contemplated in accordance with the embodiment of FIG. 2*b* and related embodiments are an affordable architectural product with good flatness and wide modules. The result can also be that panels are provided which are integrable with other types of panel joinery in other types of panels, and with various accessories such as windows, trim extrusions and louvers. Conceivably, a wide variety of metal skins (or sheet elements) may be employed, such as aluminum, steel, copper, zinc and possibly many, many more. Another attendant advantage, as will be appreciated by those of ordinary skill in the art, is concealed-fastener, pressure-equalized joinery that utilizes dry seal technology.

Figure 3A:
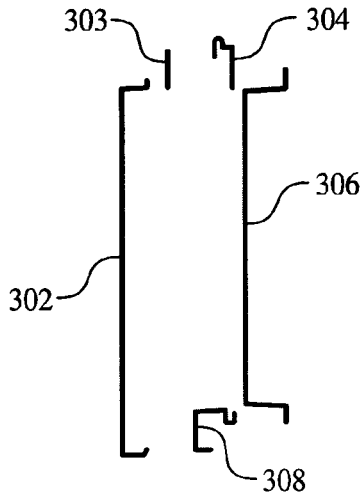
FIG. 3*a* is a schematic view of alternative metal skin components of a thin composite panel, including an interchangeable component for imparting predetermined visual features to a reveal.
Figure 3B:
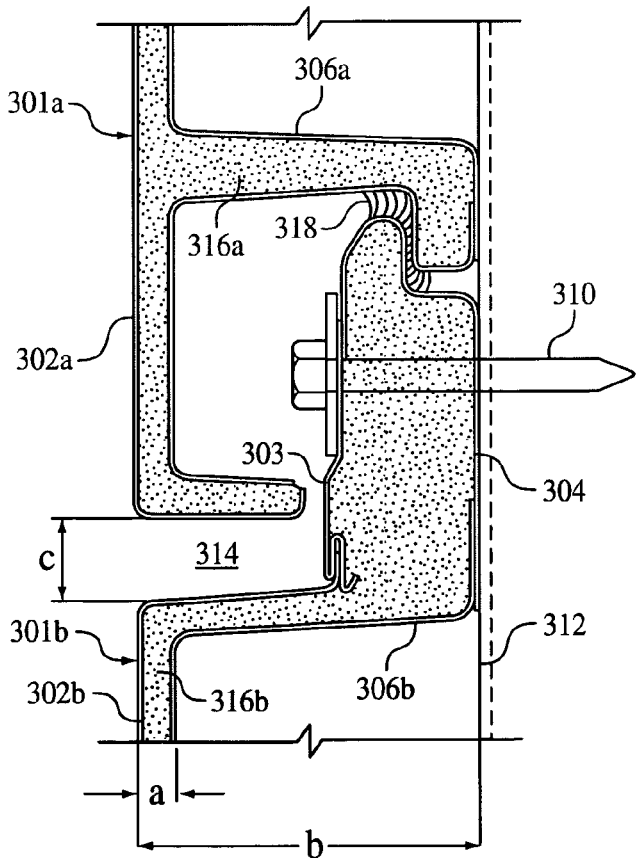
FIG. 3*b* is a close-up view of an interconnection between two thin composite panels using the metal skin components of FIG. 3*a*.

Another refinement of the present invention, as depicted in FIGS. 3*a* and 3*b*, involves forming a panel with external sheet elements that lend themselves to "reveals" having a distinct appearance. FIGS. 3*a* and 3*b* are essentially similar to FIGS. 2*a* and 2*b*, respectively, except that reference numerals for similar components are advanced by 100. Further, as shown in FIGS. 3*a* and 3*b*, a smaller face sheet element 303, traversing a short extent in parallel with inner wall 312 at the rear of reveal 314 and configured to fit snugly over a shortened terminal portion of face sheet 301*b* while being accommodated by attachment fastener 301, could preferably be provided. This element 303 can be made from a different (and, by extension, differently colored) metallic material than other sheet elements (302*a*/302*b*) that are visible from the outside of the building wall, or could simply be of a similar material but colored differently. This then provides a reliable process for "colorizing" or otherwise adding distinct visual features to a reveal that is far more effective and durable than conventional processes such as providing colored tape at the rear of a reveal. The versatility of such an arrangement should also be appreciated, in that a set of elements 303, providing different colors or visual features, could essentially be interchangeable or freely available to lend an appearance to reveal 314 as desired in the application at hand. Again, the embodiment illustrated in FIGS. 3*a* and 3*b* is illustrative rather than restrictive; a wide variety of possible configurations are conceivable within the scope of the present invention that involve the use of interchangeable sub-components for selectably altering the appearance of a reveal.

Figure 4:
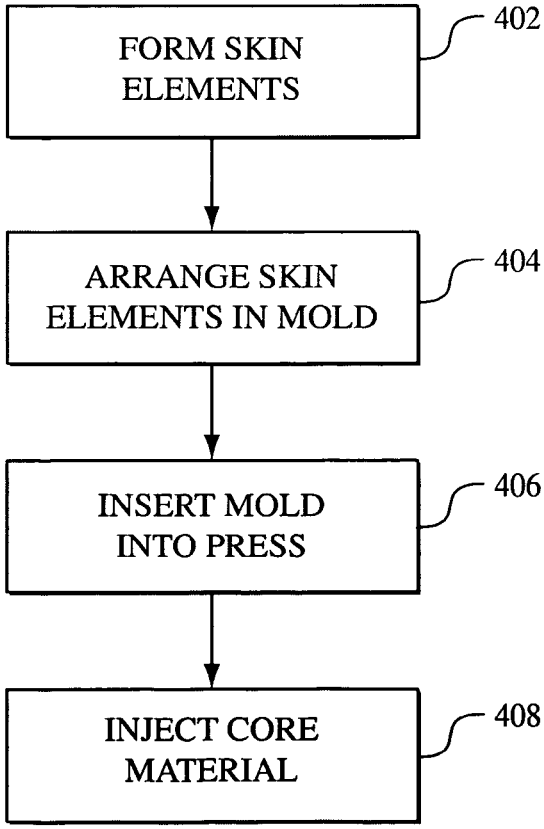
FIG. 4 schematically illustrates a panel manufacturing process.

FIG. 4 schematically illustrates a manufacturing process in accordance with an embodiment of the present invention. As shown, skin elements such as those described and illustrated with respect to FIGS. 2*a*–3*b* may be formed (402) and then arranged (404) in a mold. The mold is then preferably inserted into a press (406) for the receipt of a foam or polymeric (e.g., polyurethane) core material within the skin elements. The process of imparting the foam or polymeric core material may preferably involve injection (408) and, most preferably, reaction injection molding (or, "RIM"). RIM (e.g., as developed by the Bayer Corporation in Pittsburgh, Pa.) is used at present in the automotive industry (e.g., in forming automobile bumper systems), and has been found to provide surprising and advantageous results in connection with the formation of thin composite architectural panels. It has been found, particularly, that a RIM process is particularly well-suited to imparting a structural core into narrow and intricately shaped spaces such as those described, contemplated and illustrated herein. In view of an "aggressive" bond provided by an RIM process, structural integrity and strength are greatly enhanced, and this in turn leads to highly admirable weathering performance. If a RIM process is used to impart a polymeric core material, then the polymeric core material will preferably be thermal-set in view of the high temperatures associated with RIM.

If a RIM process is used then, with reference to FIG. 2*b*, the core material may preferably be introduced into a cavity 224 that is of sufficient volume as to adequately accommodate the high-velocity introduction of core material. As shown, such a cavity 224 may be bound by different metal sheet elements (in this case, elements 202*b*, 206*b* and 204) and may have a significantly greater thickness than a majority of the panel. Here, for instance, cavity 224 could have a sample thickness dimension d of about 0.75 inch.

In brief recapitulation, there is broadly contemplated herein, in accordance with at least one presently preferred embodiment of the present invention, a product which utilizes the economies of roll-formed edges of foamed-in-place (or poured-in-place) thicker panels and the highly desirable extreme flatness and wide module of a thin composite to offer a wide module architectural panel at reasonable cost. The panel can be made with a reaction injection molding RIM process and a high-density core material. Post-fabrication, as can be appreciated from the discussion herein, will very likely be minimal.

Among the technical advantages associated with at least one presently preferred embodiment of the present invention are the advantages gained by intricate geometry at panel ends configured for permitting adjacent panels to cooperate and essentially interlock towards forming a complete wall system. Interconnection with adjacent panels is possible in view of the tremendous strength gained from the provision of a strong structural core between roll-formed sheets separated a small distance. If a RIM process is utilized as discussed heretofore, even more significant advantages of strength, structural integrity and weathering performance are gained. These represent tremendous advantages as compared with conventional poured-in-place processes.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A thin composite architectural panel comprising:

a structural core;

a set of laminates disposed about said structural core;

a first portion for interfacing and facilitating interconnection with another thin composite architectural panel;

a second portion for interfacing and facilitating interconnection with another thin composite architectural panel;

said first interfacing portion comprising a first lip portion adapted to be interposed between a wall and a lip portion of another thin composite architectural panel in a building wall assembly; and said second interfacing portion comprising a second lip portion adapted to flank, with a wall, a lip portion of another thin composite architectural panel in a building wall assembly;

whereby the introduction of a sealant between said first lip portion and a lip portion of another thin composite architectural panel is facilitated;

whereby the introduction of a sealant between said second lip portion and a lip portion of another thin composite architectural panel is facilitated;

wherein said laminates comprise metal sheet elements;

wherein said metal sheet elements comprise:

a roll-formed face sheet element; and a roll-formed major liner sheet element disposed primarily in spaced-apart relation with respect to said face sheet element;

wherein said metal sheet elements further comprise at least one connecting liner sheet element disposed between at least one terminal portion of said face sheet element and at least one terminal portion of said major liner sheet element; and wherein one said connecting liner sheet element defines a distal end of said first lip portion.

2. The panel according to claim 1, wherein said panel comprises a major portion where said structural core and laminates have in sum an average thickness dimension of less than about 15 mm.

3. The panel according to claim 1, wherein said panel comprises a major portion where said structural core and laminates have in sum an average thickness dimension of less than about 10 mm.

4. The panel according to claim 1, wherein said face sheet element terminates in a return edge adapted to define a side of a reveal.

5. The panel according to claim 1, wherein a terminal portion of said major liner sheet element comprises a flange portion for being disposed against a wall, said flange portion defining one side of said first lip portion.

6. The panel according to claim 1, wherein said metal sheet elements further comprise a minor face sheet element connected to a terminal end of said face sheet element, said minor face sheet element being adapted to form a rear portion of a reveal associated with said panel and to impart a pre-selectable appearance solely to said reveal.

7. The panel according to claim 1, wherein a portion of said panel adjacent said second lip portion is adapted to accommodate a fastening element for fastening said panel to a wall.

8. The panel according to claim 1, wherein said structural core comprises one of: a foam structural core and a polymeric, thermal-set structural core.

9. The panel according to claim 1, wherein said structural core has been introduced within said laminates via reaction injection molding, whereby structural integrity of said panel is enhanced.

10. A thin composite architectural panel comprising:

a structural core;

a set of laminates disposed about said structural core;

a first portion for interfacing and facilitating interconnection with another thin composite architectural panel;

a second portion for interfacing and facilitating interconnection with another thin composite architectural panel;

said first interfacing portion comprising a first lip portion adapted to be interposed between a wall and a lip portion of another thin composite architectural panel in a building wall assembly; and said second interfacing portion comprising a second lip portion adapted to flank, with a wall, a lip portion of another thin composite architectural panel in a building wall assembly;

whereby the introduction of a sealant between said first lip portion and a lip portion of another thin composite architectural panel is facilitated;

whereby the introduction of a sealant between said second lip portion and a lip portion of another thin composite architectural panel is facilitated;

wherein said laminates comprise metal sheet elements;

wherein said metal sheet elements comprise:

a roll-formed face sheet element; and a roll-formed major liner sheet element disposed primarily in spaced-apart relation with respect to said face sheet element;

wherein said metal sheet elements further comprise at least one connecting liner sheet element disposed between at least one terminal portion of said face sheet element and at least one terminal portion of said major liner sheet element; and wherein one said connecting liner sheet element defines a distal end of said second lip portion.

11. The panel according to claim 10, wherein said panel comprises a major portion where said structural core and laminates have in sum an average thickness dimension of less than about 15 mm.

12. The panel according to claim 10, wherein said panel comprises a major portion where said structural core and laminates have in sum an average thickness dimension of less than about 10 mm.

13. The panel according to claim 10, wherein said face sheet element terminates in a return edge adapted to define a side of a reveal.

14. The panel according to claim 10, wherein a terminal portion of said major liner sheet element comprises a flange portion for being disposed against a wall, said flange portion defining one side of said first lip portion.

15. The panel according to claim 10, wherein a portion of said panel adjacent said second lip portion is adapted to accommodate a fastening element for fastening said panel to a wall.

16. The panel according to claim 10, wherein said structural core comprises one of: a foam structural core and a polymeric, thermal-set structural core.

17. The panel according to claim 10, wherein said structural core has been introduced within said laminates via reaction injection molding, whereby structural integrity of said panel is enhanced.

18. The panel according to claim 10, wherein said metal sheet elements further comprise a minor face sheet element connected to a terminal end of said face sheet element, element, said minor face sheet element being adapted to form a rear portion of a reveal associated with said panel and to impart a pre-selectable appearance solely to said reveal.

19. A thin composite architectural panel comprising:

a structural core;

a set of laminates disposed about said structural core;

a first portion for interfacing and facilitating interconnection with another thin composite architectural panel;

a second portion for interfacing and facilitating interconnection with another thin composite architectural panel;

said first interfacing portion comprising a first lip portion adapted to be interposed between a wall and a lip portion of another thin composite architectural panel in a building wall assembly; and said second interfacing portion comprising a second lip portion adapted to flank, with a wall, a lip portion of another thin composite architectural panel in a building wall assembly;

wherein said laminates comprise:

a face sheet element; and a major liner sheet element disposed primarily in spaced-apart relation with respect to said face sheet element;

wherein said laminates further comprise at least one connecting liner sheet element disposed between at least one terminal portion of said face sheet element and at least one terminal portion of said major liner sheet element; and wherein one said connecting liner sheet element defines a distal end of said first lip portion.

20. A thin composite architectural panel comprising:

a structural core;

a set of laminates disposed about said structural core;

a first portion for interfacing and facilitating interconnection with another thin composite architectural panel;

a second portion for interfacing and facilitating interconnection with another thin composite architectural panel;

said first interfacing portion comprising a first lip portion adapted to be interposed between a wall and a lip portion of another thin composite architectural panel in a building wall assembly; and said second interfacing portion comprising a second lip portion adapted to flank, with a wall, a lip portion of another thin composite architectural panel in a building wall assembly;

wherein said laminates comprise:

a roll-formed face sheet element; and a roll-formed major liner sheet element disposed primarily in spaced-apart relation with respect to said face sheet element;

wherein laminates further comprise at least one connecting liner sheet element disposed between at least one terminal portion of said face sheet element and at least one terminal portion of said major liner sheet element; and wherein one said connecting liner sheet element defines a distal end of said second lip portion.

* * * * *